US005950521A

United States Patent [19]

Fukushima et al.

[11] Patent Number: 5,950,521

[45] Date of Patent: Sep. 14, 1999

[54] SWASH-PLATE COMPRESSOR CAPABLE OF INSURING SUFFICIENT LUBRICATION BETWEEN A PISTON AND A SHOE SLIDABLY INTERPOSED BETWEEN THE PISTON AND A SWASH PLATE

[75] Inventors: Eiji Fukushima; Yoshitaka Ootsuki, both of Gunma, Japan

[73] Assignee: Sanden Corporation, Gunma, Japan

[21] Appl. No.: 08/993,983

[22] Filed: Dec. 18, 1997

[30] Foreign Application Priority Data

Dec. 18, 1996 [JP] Japan ..... 8-338365

[51] Int. Cl.[6] ..... F04B 53/18

[52] U.S. Cl. ..... 92/71; 92/154; 184/6.17

[58] Field of Search ..... 92/71, 154; 184/6.17

[56] References Cited

U.S. PATENT DOCUMENTS

| | | | |
|---|---|---|---|
| 2,821,932 | 2/1958 | Lucien | 417/269 |
| 3,958,901 | 5/1976 | Drevet | 417/269 |
| 4,236,878 | 12/1980 | Terauchi | 417/269 |
| 4,263,814 | 4/1981 | Takaoka et al. | 92/71 |
| 4,268,225 | 5/1981 | Nakayama et al. | 417/269 |
| 4,329,913 | 5/1982 | Nakayama et al. | 92/71 |
| 4,522,112 | 6/1985 | Nomura | 92/71 |
| 4,546,692 | 10/1985 | Lotter et al. | 92/154 |
| 4,568,252 | 2/1986 | Hattori et al. | 92/71 |
| 4,586,876 | 5/1986 | Kato et al. | 417/269 |
| 4,641,570 | 2/1987 | Futamura et al. | 92/71 |
| 4,662,267 | 5/1987 | Kaku et al. | 92/71 |
| 4,734,014 | 3/1988 | Ikeda et al. | 92/71 |
| 4,763,563 | 8/1988 | Ikeda et al. | 92/71 |
| 4,781,539 | 11/1988 | Ikeda et al. | 92/71 |
| 5,013,219 | 5/1991 | Hicks et al. | 417/269 |
| 5,131,319 | 7/1992 | Ono et al. | 92/71 |
| 5,495,789 | 3/1996 | Ogura et al. | 92/71 |
| 5,752,809 | 5/1998 | Makino et al. | 184/6.17 |

FOREIGN PATENT DOCUMENTS 3426849 1/1985 Germany .

*Primary Examiner*—Sheldon J. Richter
*Attorney, Agent, or Firm*—Baker & Botts, L.L.P.

[57] ABSTRACT

In a swash plate compressor (1) comprising a shoe (8) disposed between, and being in sliding contact with, a piston (7) and a swash plate (6), at least one of a shoe receiving surface (73*e*) of the piston (7) and a piston-side sliding surface (8*b*) of the shoe (8) is provided with an oil path (73*f*, 73*g*) for allowing the flow of a lubricating oil therebetween.

7 Claims, 6 Drawing Sheets

SWASH-PLATE COMPRESSOR CAPABLE OF INSURING SUFFICIENT LUBRICATION BETWEEN A PISTON AND A SHOE SLIDABLY INTERPOSED BETWEEN THE PISTON AND A SWASH PLATE

BACKGROUND OF THE INVENTION

This invention relates to a swash-plate compressor and, in particular, to a swash-plate compressor comprising a swash plate coupled to a piston through a shoe slidably interposed therebetween.

A conventional swash plate compressor comprises a casing, a cylinder block formed in the casing and formed with a plurality of cylinder bores angularly spaced about an axis, a rotary shaft extending on the axis and rotatably supported in the casing, a swash plate attached to the rotary shaft to be rotated together with the rotary shaft, a plurality of pistons each having a head portion slidably fitted into the cylinder bore and a shoe receiving portion connected to the head portion, and a pair of shoes which are slidably disposed on the shoe receiving portion of the piston and kept in sliding contact with an outer periphery of the swash plate interposed between the shoes so that rotary motion of the rotary shaft is converted into a linear reciprocating motion of each piston through the swash plate and the shoes. The shoe receiving portion has a pair of shoe receiving recesses with spherically concave shoe receiving surfaces for receiving the shoes, respectively. Each of the shoes has a piston-side sliding surface of a spherical convex to be brought into sliding contact with each of the shoe receiving surfaces. On the other hand, each of the shoes has the opposite flat surface as a swash plate-side sliding surface which is in sliding contact with a flat surface of the swash plate.

In the conventional swash-plate compressor, the shoe receiving surface of the piston has a radius of curvature substantially equal to that of the piston-side sliding surface of the shoe.

Thus, in the conventional swash-plate compressor, the shoe receiving surface and the piston-side sliding surface have spherical shapes exactly coincident with each other. This means that substantially no clearance is produced between the shoe receiving surface and the piston-side sliding surface. Therefore, a mist of a lubricating oil contained in a refrigerant gas within the swash-plate compressor is hardly introduced between the shoe receiving surface and the piston-side sliding surface. In this event, lubrication between the shoe receiving surface and the piston-side sliding surface is insufficient. This often results in occurrence of seizure therebetween and in an increase in driving load of the compressor.

SUMMARY OF THE INVENTION

It is therefore an object of this invention to provide a swash-plate compressor capable of assuring sufficient lubrication between a piston and a shoe by a lubricating oil contained in a refrigerant gas.

A swash-plate compressor to which this invention is applicable comprises a casing, a cylinder block formed in the casing and formed with a plurality of cylinder bores angularly spaced about an axis, a rotary shaft extending on the axis and rotatably supported in the casing, a swash plate attached to the rotary shaft to be rotated together with the rotary shaft, a plurality of pistons each having a head portion slidably fitted into the cylinder bore and a shoe receiving portion connected to the head portion, and a pair of shoes which are slidably disposed on the shoe receiving portion of the piston and kept in sliding contact with an outer periphery of the swash plate interposed between the shoes so that rotary motion of the rotary shaft is converted into a linear reciprocating motion of each piston through the swash plate and the shoes. The shoe receiving portion has a pair of shoe receiving recesses with spherically concave shoe receiving surfaces for receiving the shoes, respectively. Each of the shoes has a piston-side sliding surface of a spherical convex to be brought into sliding contact with each of the shoe receiving surfaces. According to this invention, at least one of the shoe receiving surface and the piston-side sliding surface is provided with an oil path for allowing the flow of a lubricating oil between the shoe receiving surface and the piston-side sliding surface.

DESCRIPTION OF THE PREFERRED EMBODIMENTS

In order to facilitate an understanding of this invention, description will at first be made about a conventional swash-plate compressor with reference to the drawings.

Figure 1A:
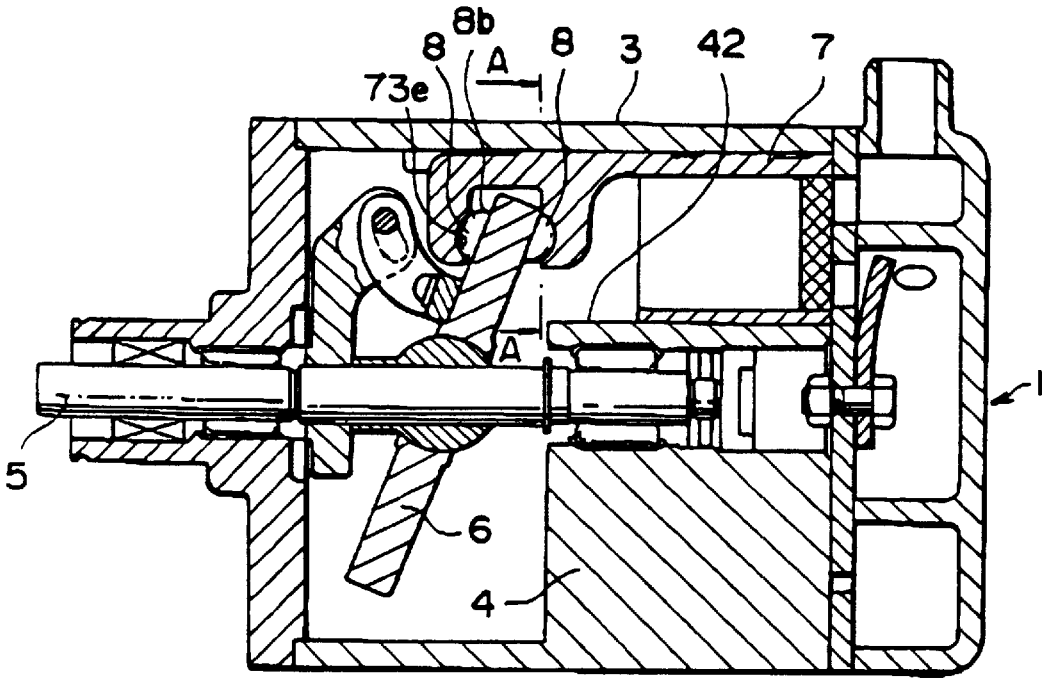
FIG. 1A PRIOR ART
FIG. 1A is a vertical sectional view of a conventional swash-plate compressor.
Figure 1B:
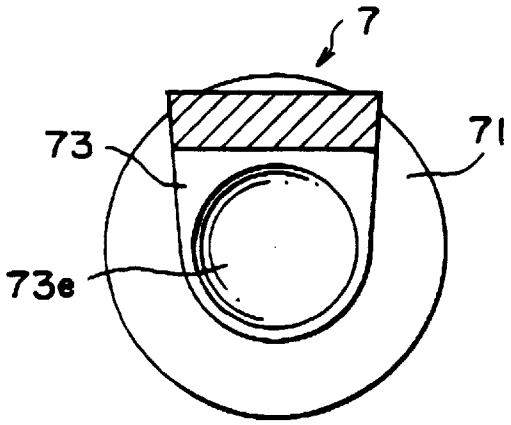
FIG. 1B PRIOR ART
FIG. 1B is a sectional view taken along a line A—A in FIG. 1A.

Referring to FIGS. 1A and 1B, the conventional swash-plate compressor 1 comprises a casing 3 with a cylinder block 4 in which a plurality of cylinder bores 42 formed to extend in parallel with an axis and to be equiangularly spaced about the axis. A rotary shaft 5 is rotatably supported in the casing 3 to which a swash plate 6 is attached to be rotatable together with the rotary shaft 5. A plurality of single-head pistons 7 are also disposed within the casing. Each of the pistons 7 has a head portions 71 slidably fitted into the corresponding one of the cylinder bores 42 and a shoe receiving portion 73 connected to the head portion 71. A pair of shoes 8 are slidably disposed on the shoe receiving portion 73 of the single-head piston 7 and kept in sliding contact with an outer periphery of the swash plate 6 interposed between the shoes 8. Thus, rotary motion of the rotary shaft 5 is converted into a linear reciprocating motion of each piston 7 through the swash plate 6 and the shoes 8.

The shoe receiving portion 73 has a pair of shoe receiving recesses with spherically concave shoe receiving surfaces

73*e* for receiving the shoes 8, respectively. Each of the shoes 8 has a piston-side sliding surface 8*b* of a spherical convex to be brought into sliding contact with each of the shoe receiving surfaces 73*e*. On the other hand, each of the shoes 8 has the opposite flat surface as a swash plate-side sliding surface which is in sliding contact with a flat surface of the swash plate 6. The shoe receiving surface 73*e* of the single-head piston 7 has a radius of curvature substantially equal to that of the piston-side sliding surface 8*b* of the shoe 8. Therefore, the shoe receiving surface 73*e* and the piston-side sliding surface 8*b* have spherical shapes exactly coincident with each other. This means that substantially no clearance is produced between the shoe receiving surface 73*e* and the piston-side sliding surface 8*b*.

Therefore, the conventional swash-plate compressor 1 has those disadvantages described in the preamble.

Figure 2:
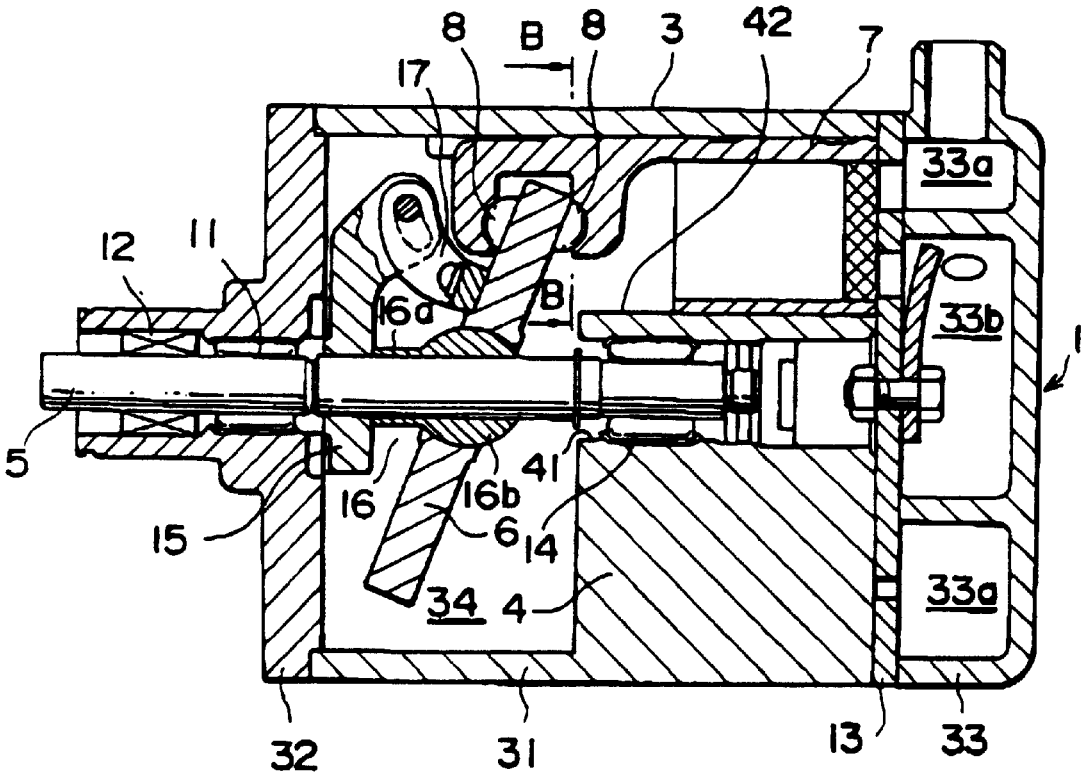
FIG. 2 is a vertical sectional view of a swash-plate compressor according to a first embodiment of this invention.
Figure 3:
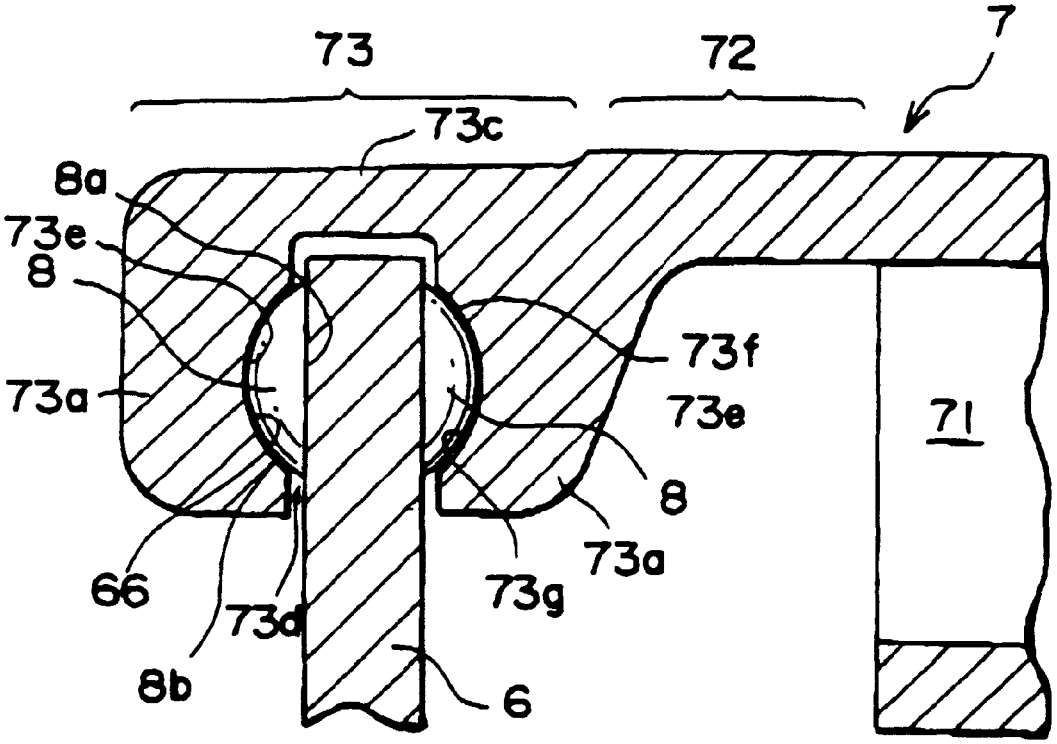
FIG. 3 is an enlarged sectional view of a main portion of a single-head piston in the compressor of FIG. 2.

Next referring to FIGS. 2 through 4, description will be made about a swash-plate compressor according to a first embodiment of this invention. The swash-plate compressor 1 comprises a casing 3, a cylinder block 4 having a plurality of cylinder bores 42, a rotary shaft 5, a swash plate 6, a plurality of single-head pistons 7, and a pair of shoes 8, which are assembled in an arrangement similar to that shown in FIG. 1A.

The casing 3 comprises a casing body 31, a front end plate 32, and a cylinder head 33. The casing body 31 is of a cylindrical shape and is integrally formed with the cylinder block 4. The front end plate 32 has a generally funnel-like shape and attached to one open end of the casing body 31 to close the one open end. Thus, a crank chamber 34 is defined between the cylinder block 4 and the front end plate 32. The front end plate 32 has a shaft seal cavity in which a radial needle bearing 11 and a shaft seal member 12 are disposed. The cylinder head 33 has a suction chamber 33*a* and a discharge chamber 33*b* and is attached to the other end of the casing body 31 through a valve plate 13.

The cylinder block 4 has a center hole 41 and the cylinder bores 42 equiangularly spaced about an axis of the rotary shaft 5. The center hole 41 is formed in a portion of the cylinder block 4 at a center of the plurality of cylinder bores 42. Within the center hole 41, a radial needle bearing 14 is disposed. The cylinder bores 42 are formed in an outer peripheral zone of the cylinder block 4 at an equal interval in a circumferential direction to surround the center hole 41.

The rotary shaft 5 has one end portion rotatably supported by the front end plate 32 through the radial needle bearing 11 and the other end portion rotatably supported by the cylinder block 4 through the radial needle bearing 14. A top of the one end portion of the rotary shaft 5 protrudes through the front end plate 32 outward of the casing 3. A gap between the rotary shaft 5 and the front end plate 32 is sealed by the shaft seal member 12. On the rotary shaft 5, a rotor 15 and a swash-plate fitting member 16 are mounted. The rotor 15 is fixed to the rotary shaft 5 to be rotatable with the rotary shaft 5. The swash-plate fitting member 16 comprises a cylindrical member 16*a* and a spherical or ball portion 16*b* and is movable on the rotary shaft 5 in an axial direction of the rotary shaft 5.

The swash plate 6 has a disk shape and is rotatably attached on the ball portion 16*b* of the swash-plate fitting member 16. Furthermore, the swash plate 6 is coupled to the rotor 15 through an arm 17 swingably coupled to a top end portion of the rotor 15. With this structure, the swash plate 6 is rotated together with the rotary shaft 5 and can be varied in its inclination angle with respect to the axial direction. Thus, the compressing capacity of this compressor is variable dependent on the inclination angle.

Each of the single-head pistons 7 has a head portion 71, a coupling portion 72, and a shoe receiving portion 73. The head portion 71 is slidably inserted into the cylinder bore 42. The coupling portion 72 couples the head portion 71 and the shoe receiving portion 73. The shoe receiving portion 73 comprises a pair of shoe receiving pieces 73*a* extending towards the rotary shaft 5 from a base part 73*c*. A space defined between the shoe receiving pieces 73*a* serves as a groove 73*d* in which an outer periphery of the swash plate 6 is received. Each of the shoe receiving pieces 73*a* has a shoe receiving recess of a spherically concave shoe receiving surface 73*e* receiving each of the shoes 8 therein.

Each shoe 8 is of a generally dome-like shape and has a plate-side sliding surface 8*a* of a flat shape in sliding contact with the swash plate 6 and a piston-side sliding surface 8*b* of a spherical convex in sliding contact with the shoe receiving surface 73*e* of the single-head piston 7.

In this embodiment, each of the shoe receiving surfaces 73*e* of the single-head piston 7 is provided with an oil path for a lubricating oil. The oil path comprises two lubricating grooves 73*f* and 73*g* formed in the shoe receiving surface 73*e*. The lubricating grooves 73*f* and 73*g* communicate with each other and have a same configuration. The lubricating grooves 73*f* and 73*g* extend from a center point of the shoe receiving surface 73*e* or an apex of the spherical concave in opposite directions along an imaginary plane including the center point and the the axis of the rotary shaft 5. Specifically, each of the lubricating grooves 73*f* and 73*g* has a sectorial shape expanding outward from the center point of the shoe receiving surface 73*e* in a front view as viewed from a front of the shoe receiving recess. The sectorial shape has a center angle preferably within a range greater than 0° and not greater than 10° and a depth preferably within a range greater than 0 $\mu$m and not greater than 15 $\mu$m. Each of the lubricating grooves 73*f* and 73*g* has an arcuate bottom having a radius of curvature greater than that of the spherical concave surface of the shoe receiving surface 73*e* and, therefore, the piston-side sliding convex surface 8*b* of the shoe 8.

In this embodiment, the cylinder block 4 is integrally formed with the casing body 31. It will readily be understood that the cylinder block 4 may be a different component separated from the casing body 31 and assembled with the casing body 31.

Figure 5:
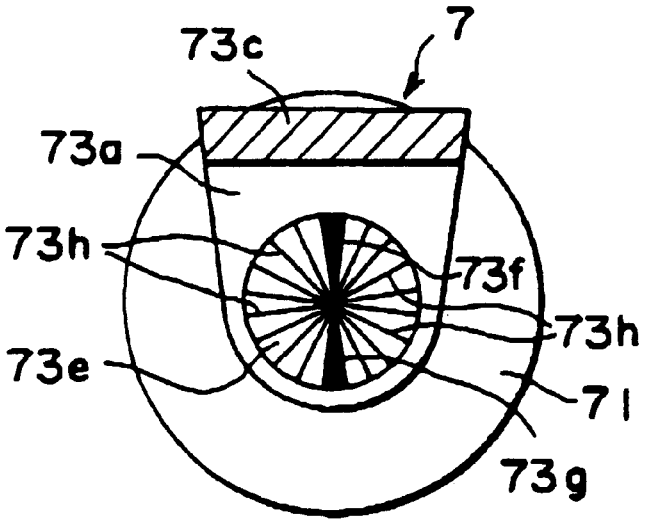
FIG. 5 is a sectional view similar to FIG. 4 but showing a single-head piston of a swash-plate compressor according to a second embodiment of this invention.

Referring to FIG. 5, a swash-plate compressor according to a second embodiment of this invention is similar in structure to the first embodiment except that an oil path is different. Similar parts are designated by like reference numerals.

Figure 4:
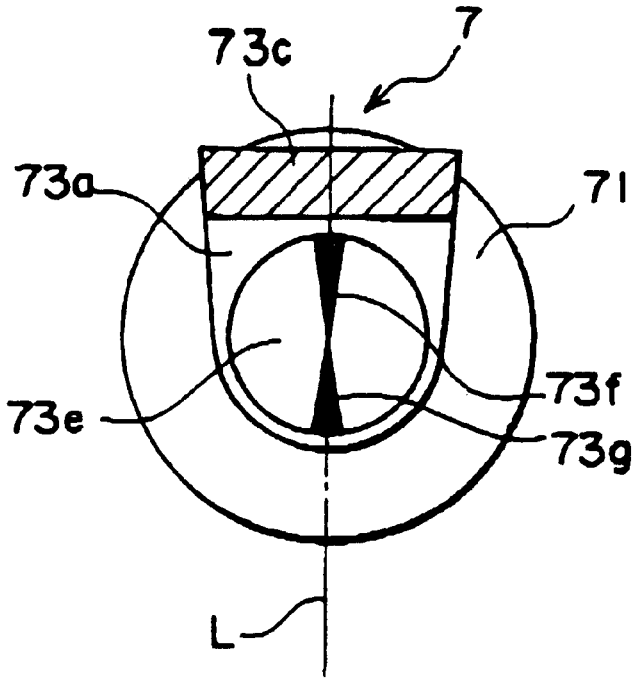
FIG. 4 is a sectional view taken along a line B—B in FIG. 2.

The oil path in this embodiment comprises the lubricating grooves 73*f* and 73*g* similar to those in FIG. 4 and additionally a plurality of fine grooves 73*h* formed in the concave of the shoe receiving surface 73*e*. The fine grooves 73*h* radially outwardly extend from the center point of the shoe receiving surface 73*e*. The fine grooves 73*h* utilize groove-like scratches produced when the shoe receiving piece 73*a* is machined by the use of a machining center to form the shoe receiving surface 73 of the spherical concave. In the conventional compressor, the groove-like scratches have been removed by finishing to smooth concave surface.

Figure 6:
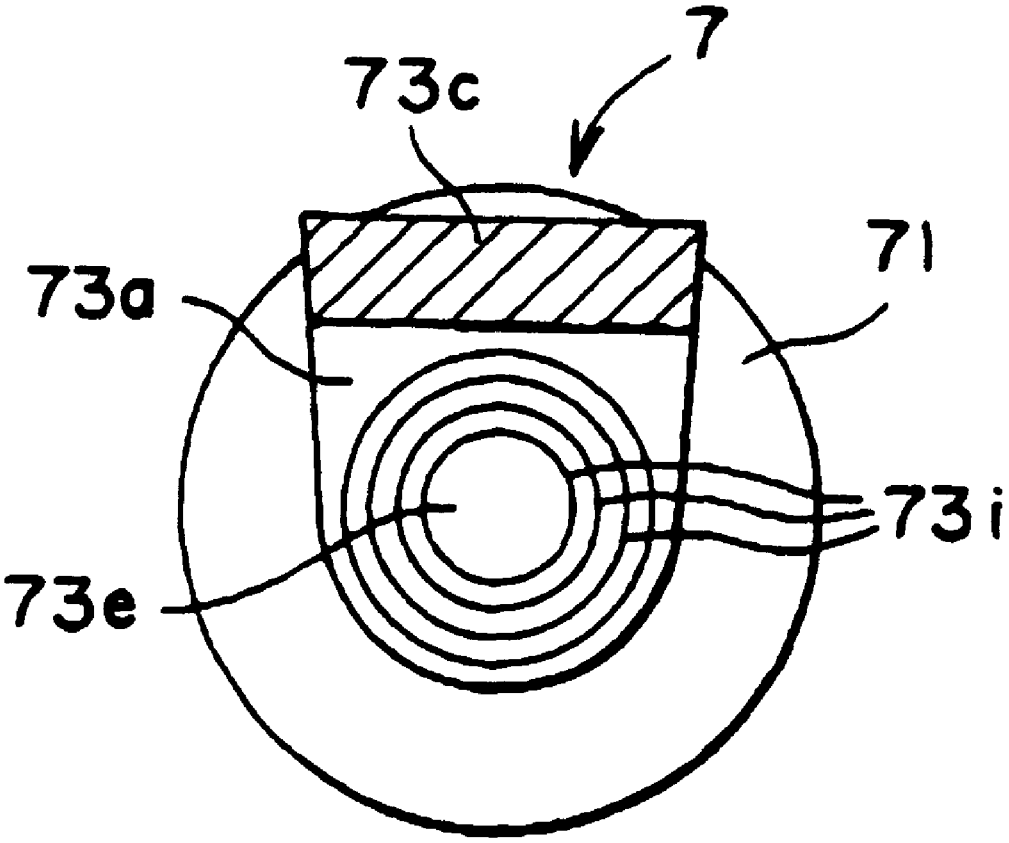
FIG. 6 is a sectional view similar to FIG. 4 but showing a single-head piston of a swash-plate compressor according to a third embodiment of this invention.

Referring to FIG. 6, a swash-plate compressor according to a third embodiment of this invention is similar in structure to the first embodiment except that an oil path is different. Similar parts are designated by like reference numerals.

The oil path in this embodiment comprises a plurality of annular grooves 73*i* concentrically formed in the shoe receiving surface 73*e* of the concave.

Figure 7:
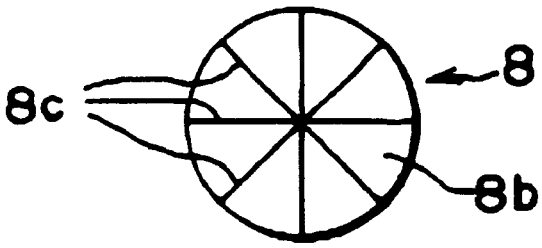
FIG. 7 is a bottom view of a shoe used in a swash-plate compressor according to a fourth embodiment of this invention.

Referring to FIG. 7, a swash-plate compressor according to a fourth embodiment of this invention is similar in structure to the first embodiment except that an oil path is not formed in the shoe receiving surface (73*e* in FIGS. 3 through 5) of the single-head piston but is formed in the convex of the shoe 8.

The oil path in this embodiment comprises a plurality of lubricating grooves 8*c* formed in the piston-side sliding surface 8*b* of the shoe 8. The lubricating grooves 8*c* radially extend from an apex or a center point of the convex of the piston-side sliding surface 8*b*.

Figure 8:
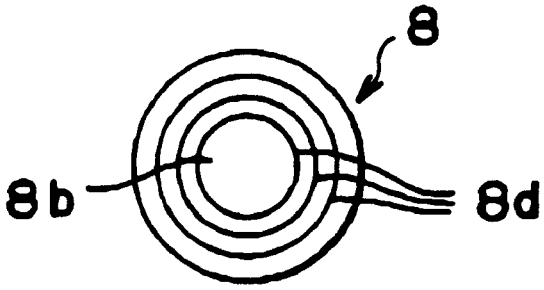
FIG. 8 is a bottom view of a shoe used in a swash-plate compressor according to a fifth embodiment of this invention.

Referring to FIG. 8, a swash-plate compressor according to a fifth embodiment of this invention is similar in structure to the fourth embodiment but is different therefrom in the structure of the grooves.

The oil path in this embodiment comprises a plurality of annular grooves 8*d* formed in the piston-side sliding convex surface 8*b* of the shoe 8. The annular grooves 8*d* are concentrical to each other about the apex of the convex of the piston-side sliding surface 8*b*.

In each of the foregoing embodiments, the oil path is formed in one of the shoe receiving surface of the single-head piston and the piston-side sliding surface of the shoe. As will readily be understood, the oil path may be formed in both of the shoe receiving surface and the piston-side sliding surface. Each of the foregoing embodiments is directed to the swash-plate compressor of a single-head type with the single head piston 7 having the head portion 71 at one side of the shoe receiving portion 73. It will be noted that this invention is also applicable to a double-head type swash-plate compressor with a double head piston having head portions at both sides of the shoe receiving portion.

As described above, the oil path is formed in at least one of the shoe receiving surface of the piston and the piston-side sliding surface of the shoe. With this structure, a mist of the lubricating oil contained in a refrigerant gas is introduced between the shoe receiving surface and the piston-side sliding surface through the oil path. Thus, it is possible according to this invention to assure sufficient lubrication between the shoe receiving surface and the piston-side sliding surface.

What is claimed is:

1. A swash-plate compressor comprising a casing, a cylinder block formed in said casing and formed with a plurality of cylinder bores angularly spaced about an axis, a rotary shaft extending on said axis and rotatably supported in said casing, a swash plate attached to said rotary shaft to be rotatable together with said rotary shaft, a plurality of pistons each having a head portion slidably fitted into a corresponding one of said cylinder bores and a shoe receiving portion connected to said head portion, and a pair of shoes slidably disposed on said shoe receiving portion of said piston and kept in sliding contact with an outer periphery of said swash plate interposed between said pair of shoes so that rotary motion of said rotary shaft is converted into a linear reciprocating motion of each of said pistons through said swash plate and said shoes, said shoe receiving portion having a pair of shoe receiving recesses with spherically concave shoe receiving surfaces for receiving said shoes, respectively each of said shoes having a piston-side sliding surface of a spherical convex to be brought into sliding contact with each of said shoe receiving surfaces, wherein at least one of said shoe receiving surface and said piston-side sliding surface is provided with an oil path for allowing the flow of a lubricating oil between said shoe receiving surface and said piston-side sliding surface;

wherein said oil path comprises a pair of lubricating grooves formed in said shoe receiving surface, said lubricating grooves extending from a center point of said shoe receiving surface in opposite directions along an imaginary plane including said center point and said axis of said rotary shaft.

2. A swash-plate compressor as claimed in claim 1, wherein each of said lubricating grooves has a sectorial shape expanding outward from the center point as viewed from a front side of said shoe receiving surface.

3. A swash-plate compressor as claimed in claim 2, wherein each of said lubricating grooves of a sectorial shape has a center angle within a range greater than 0° and not greater than 10° and a depth within a range greater than 0 $\mu$m and not greater than 15 $\mu$m.

4. A swash-plate compressor as claimed in claim 2, wherein said oil path further comprises a plurality of fine grooves radially extending from said center point of said shoe receiving surface.

5. A swash-plate compressor as claimed in claim 4, wherein each of said fine grooves has a depth within a range between 1 $\mu$m and 6 $\mu$m.

6. A swash-plate compressor comprising a casing, a cylinder block formed in said casing and formed with a plurality of cylinder bores angularly spaced about an axis, a rotary shaft extending on said axis and rotatably supported in said casing, a swash plate attached to said rotary shaft to be rotatable together with said rotary shaft, a plurality of pistons each having a head portion slidably fitted into a corresponding one of said cylinder bores and a shoe receiving portion connected to said head portion, and a pair of shoes slidably disposed on said shoe receiving portion of said piston and kept in sliding contact with an outer periphery of said swash plate interposed between said pair of shoes so that rotary motion of said rotary shaft is converted into a linear reciprocating motion of each of said pistons through said swash plate and said shoes, said shoe receiving portion having a pair of shoe receiving recesses with spherically concave shoe receiving surfaces for receiving said shoes, respectively, each of said shoes having a piston-side sliding surface of a spherical convex to be brought into sliding contact with each of said shoe receiving surfaces, wherein at least one of said shoe receiving surface and said piston-side sliding surface is provided with an oil path for allowing the flow of a lubricating oil between said shoe receiving surface and said piston-side sliding surface;

wherein said oil path comprises a plurality of concentrically formed annular grooves.

7. A swash-plate compressor comprising a casing, a cylinder block formed in said casing and formed with a plurality of cylinder bores angularly spaced about an axis, a rotary shaft extending on said axis and rotatably supported in said casing, a swash plate attached to said rotary shaft to be rotatable together with said rotary shaft, a plurality of pistons each having a head portion slidably fitted into a corresponding one of said cylinder bores and a shoe receiving portion connected to said head portion, and a pair of shoes slidably disposed on said shoe receiving portion of said piston and kept in sliding contact with an outer periphery of said swash plate interposed between said pair of shoes so that rotary motion of said rotary shaft is converted into a linear reciprocating motion of each of said pistons through said swash plate and said shoes, said shoe receiving portion having a pair of shoe receiving recesses with spherically concave shoe receiving surfaces for receiving said shoes, respectively, each of said shoes having a piston-side sliding surface of a spherical convex to be brought into sliding contact with each of said shoe receiving surfaces, wherein at least one of said shoe receiving surface and said piston-side sliding surface is provided with an oil path for allowing the flow of a lubricating oil between said shoe receiving surface and said piston-side sliding surface;

wherein said oil path comprises a plurality of lubricating grooves radially extending from a center point of said at least one of said shoe receiving surface and said piston-side sliding surface.

* * * * *